US006981338B2

(12) United States Patent
Jensen et al.

(10) Patent No.: US 6,981,338 B2
(45) Date of Patent: Jan. 3, 2006

(54) DEVICE FOR IMPROVED REMOVAL OF LIQUID FROM FABRIC

(76) Inventors: Dale S. Jensen, 475 E. 520 South, Smithfield, UT (US) 84335; Edward E. Durrant, 274 S. 485 West, Providence, UT (US) 84332

( * ) Notice: Subject to any disclaimer, the term of this patent is extended or adjusted under 35 U.S.C. 154(b) by 0 days.

(21) Appl. No.: 10/743,930

(22) Filed: Dec. 23, 2003

(65) Prior Publication Data

US 2005/0132605 A1 Jun. 23, 2005

(51) Int. Cl.
*F26B 13/30* (2006.01)

(52) U.S. Cl. ..... 34/92; 15/320

(58) Field of Classification Search ..... 34/81, 34/84, 92, 95.1, 638; 15/320, 321
See application file for complete search history.

(56) References Cited

U.S. PATENT DOCUMENTS

| | | | | | |
|---|---|---|---|---|---|
| 3,775,053 | A | * | 11/1973 | Wisdom | 8/142 |
| 4,000,538 | A | | 1/1977 | Tissier | 15/320 |
| 4,095,309 | A | | 6/1978 | Sundheim | 15/320 |
| 4,182,001 | A | | 1/1980 | Krause | 15/320 |
| 4,270,238 | A | | 6/1981 | Shallenberg et al. | 15/321 |
| 4,275,478 | A | * | 6/1981 | Kohlenberger | 15/401 |
| 4,391,017 | A | | 7/1983 | Bruensicke | 15/313 |
| 4,677,705 | A | | 7/1987 | Schuster | 15/398 |
| 4,692,959 | A | | 9/1987 | Monson | 15/320 |
| 5,105,503 | A | * | 4/1992 | Holland | 15/322 |
| 5,463,791 | A | | 11/1995 | Roden | 15/320 |
| 5,555,598 | A | * | 9/1996 | Grave et al. | 15/322 |
| 5,867,861 | A | * | 2/1999 | Kasen et al. | 15/320 |
| 5,992,051 | A | | 11/1999 | Salehibakhsh | 34/638 |
| 6,055,699 | A | * | 5/2000 | Cho | 15/321 |
| 6,243,914 | B1 | * | 6/2001 | Studebaker | 15/322 |
| 6,266,892 | B1 | | 7/2001 | Haynie | 34/84 |
| 6,298,577 | B1 | | 10/2001 | Haynie | 34/84 |
| 6,560,818 | B1 | * | 5/2003 | Hasko | 15/321 |
| 6,568,024 | B2 | * | 5/2003 | Kent et al. | 15/322 |

* cited by examiner

*Primary Examiner*—Stephen Gravini
(74) *Attorney, Agent, or Firm*—Starkweather & Associates; Michael W. Starkweather; Jason P. Webb

(57) ABSTRACT

A device for enhancing removal of liquid from fabric, such as a vacuum head device for removing liquid from carpet, includes a first and second surface forming an extraction slot. The first surface may include a plurality of channels extending towards the extraction slot configured to direct the liquid toward the extraction slot. Alternatively, the first surface may have a smaller surface area and the second surface may be configured with a lower surface in order to penetrate the carpet and act as a squeegee. The cross-sections of the first and second surfaces are preferably circular. In another embodiment, the cross-sections of the first and second surfaces may comprise, but are not limited to, a semi-rectangular cross section, a V-shaped cross-section, or an elliptical cross-section.

36 Claims, 4 Drawing Sheets

DEVICE FOR IMPROVED REMOVAL OF LIQUID FROM FABRIC

BACKGROUND OF THE INVENTION

1. Field of the Invention

The present invention relates generally to a device for improving the efficiency of a carpet cleaning machine and other extraction machines in removing cleaning solution and other liquids from fabric, such as carpet. More particularly, the present invention relates to an improved vacuum head for extracting a fluid from carpet.

2. Description of the Related Art

Carpet-cleaning machines spray a cleaning solution onto a fabric or carpet and then vacuum the solution from the carpet into the machine. Other extraction machines may spray a liquid onto a fabric or simply remove a pre-existing liquid from the fabric.

Carpet-cleaning machines typically include a wand with a cleaning head that is movable over the carpet, or a rotating platform that rotates one or more cleaning heads over the carpet. The cleaning heads usually include a spray nozzle for spraying a liquid, such as a cleaning solution, onto and/or into the carpet. In addition, the cleaning heads usually include a vacuum head for vacuuming or sucking the fluid, and any dirt, from the carpet. The vacuum heads commonly include a large opening, such as with an inverted funnel, which sits and moves atop the carpet vacuuming or sucking the fluid, and any dirt from the carpet.

One disadvantage with many vacuum heads is their inefficiency. Some vacuum heads remove less than 20% of the fluid. It will be appreciated that the fluid remaining in the carpet renders the carpet wet, and thus off limits for many hours while the carpet dries. In addition it will be appreciated that a significant amount of dirt remains in the carpet with the remaining fluid. What is needed is a vacuum head device for removing a fluid that overcomes many or all of these limitations.

The following patents are offered to assist in understanding the state of the art known to be at least somewhat related to the present invention, and are herein incorporated by reference for their supporting teachings:

U.S. Pat. No. 4,000,538 is a cleaning device.

U.S. Pat. No. 4,095,309 is an apparatus for cleaning a carpet.

U.S. Pat. No. 4,182,001 is a surface cleaning and rinsing device.

U.S. Pat. No. 4,270,238 is a cleaning tool.

U.S. Pat. No. 4,391,017 is a device for removing incendiary matter from the interior of an aircraft.

U.S. Pat. No. 4,677,705 is an exhauster nozzle.

U.S. Pat. No. 4,692,959 is a rotary cleaner/scrubber mechanism.

U.S. Pat. No. 5,463,791 is a surface cleaning appliance.

U.S. Pat. No. 5,992,051 is the carpet drying system.

U.S. Pat. No. 6,266,892 B1 is a device for enhancing removal of liquid from fabric.

U.S. Pat. No. 6,298,577 B1 is a device for enhancing removal of liquid from fabric.

BRIEF SUMMARY OF THE INVENTION

The present invention has been developed in response to the present state of the art, and in particular, in response to the problems and needs in the art that have not yet been fully solved by currently available vacuum head devices. Accordingly, the present invention has been developed to provide a device for vacuum systems that overcome many or all of the above-discussed shortcomings in the art.

A vacuum head device for removal of liquid from an object is provided. In one embodiment the vacuum head device may comprise a first surface coupled to the device, a second surface coupled to the device and configured to penetrate the fabric, and an extraction slot formed by the first and second surface. Preferably, the vacuum head device is configured to remove a liquid from a carpeted surface. However, the vacuum head device functions equally well removing a liquid from a fabric.

The first and second surfaces may have a V-shaped cross-section. In further embodiments, the surfaces may have, but are not limited to a substantially circular cross-section, or a substantially rectangular cross-section, with rounded edges. Additionally, the first surface may comprise a plurality of channels extending toward the extraction slot, the plurality of channels configured to force liquid towards the extraction slot.

In one embodiment, the plurality of channels is disposed at a bottom surface of the V-shaped cross section. Furthermore, the first surface may comprise a plurality of contact points disposed between the channels configured to apply pressure to the object.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
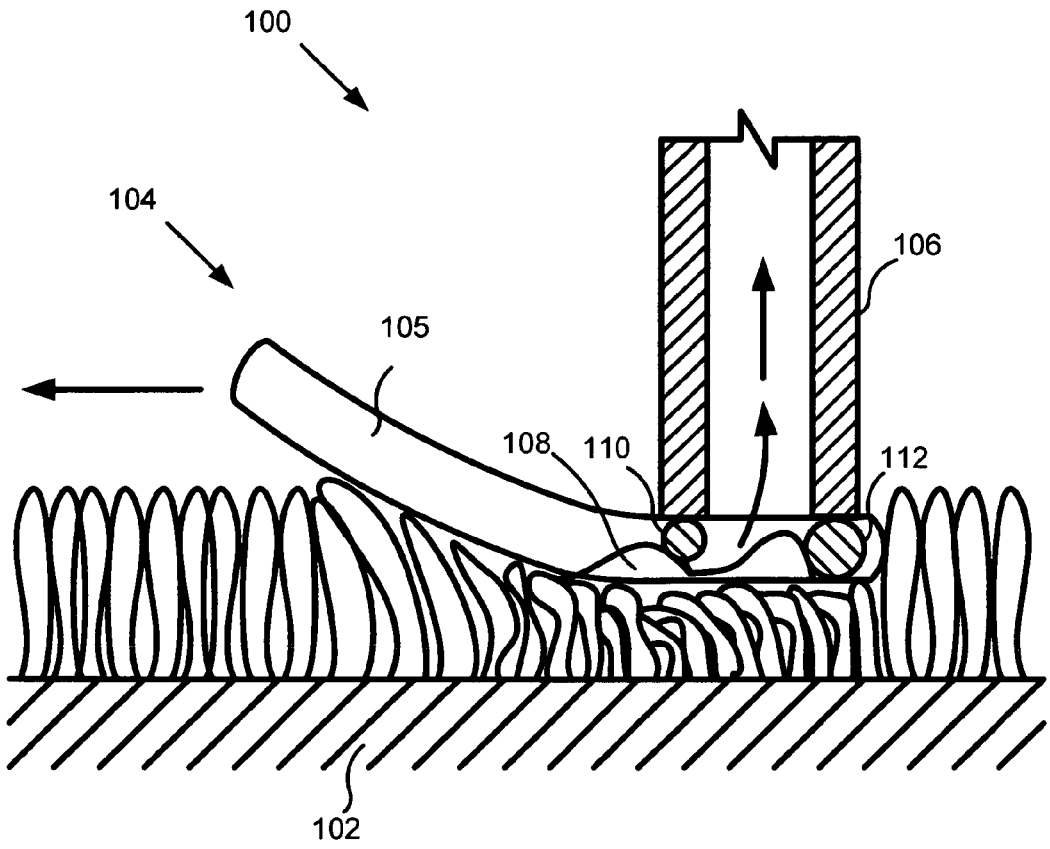
FIG. 1 is a schematic block diagram illustrating a cross-section of one embodiment of a vacuum system in accordance with the present invention.

FIG. 1 is a schematic block diagram illustrating a cross-section of one embodiment of a vacuum system 100. The vacuum system 100 may be used to withdraw fluid from a carpeted surface 102. Such a system 100 maybe constructed initially in a carpet cleaning machine or other machine, or it may be attached to existing machines. The vacuum system 100 may comprise a vacuum head device 104 coupled to the vacuum machine 106. The vacuum system 100 is movable on or through the carpeted surface 102, and the vacuum machine 106 is configured to withdraw a fluid 108 under a vacuum force supplied by the vacuum system 100, as is well known in the art.

In one embodiment, the vacuum head device 104 comprises a first surface, leading portion, or leading member 110 and a second surface, trailing portion, or trailing member 112. As depicted, the cross-sections of the surfaces 110, 112 may be substantially circular. Additionally, the first surface 110, or leading surface, is preferably smaller. The surfaces 110, 112 are attached to the portion of the device 104 that will contact the fabric or carpeted surface 102 so that the when force is applied the surfaces 110, 112 will extend into the fabric. The surfaces 110, 112 may be oriented and shaped in any fashion that will push liquid 108 toward the vacuum machine 106 for extraction. The second, larger surface 112 acts as a barrier to the liquid 108 and functions in a manner similar to the way that a snow plow pushes snow ahead and to the side of the plow. There is also a sloping member 105 configured to facilitate travel of the device across fabric. As shown in the illustration, the sloping member provides a ramped interface surface to the fabric as the device travels across the fabric.

As will be described with reference to FIGS. 2 and 3, the surfaces 110, 112 may be bars to which the vacuum machine 106 is attached. Alternatively, the surfaces 110, 112 may have, but are not limited to, a substantially rectangular cross-section, a V-shaped cross-section, or an elliptical cross-section. A gasket (not shown) that is well known in the art may be placed between the vacuum machine 106 and the vacuum head device 104 to form a seal when the device 104 is attached. In a further embodiment, the vacuum head device 104 may be attached to a wand or other nozzle.

Figure 2:
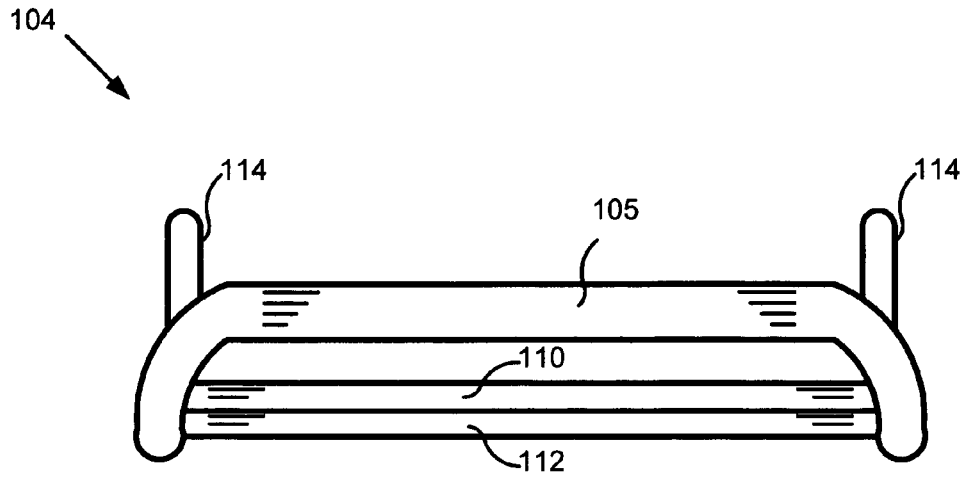
FIG. 2 is a schematic block diagram illustrating one embodiment of a vacuum head device in accordance with the present invention.

FIGS. 2 is a schematic block diagram illustrating one embodiment of the vacuum head device 104 of the present invention. As illustrated, the vacuum head device 104 may comprise the first surface 110, and the second surface 112 as described above. Additionally, the vacuum head device may have protrusions 114 for coupling the vacuum head device 104 to a vacuum device (not shown). In one embodiment, only the protrusions 114 are inserted into the vacuum device wand or other attachment. The protrusions 114 prevent the above described gasket from inadvertently obstructing fluid extraction.

Figure 3:
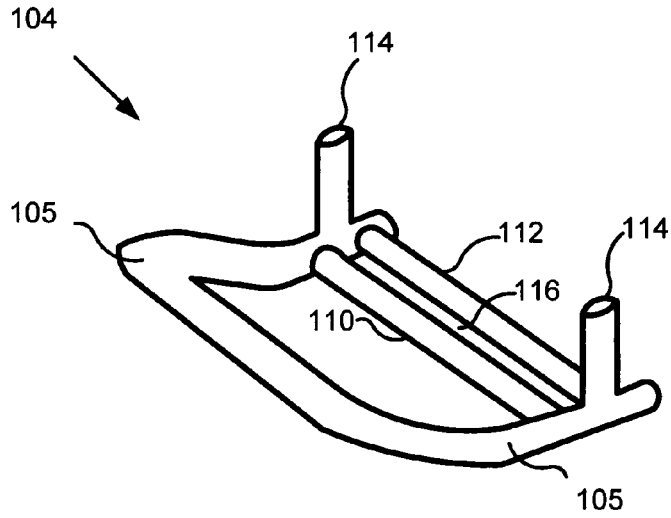
FIG. 3 is a top and side perspective view diagram illustrating one embodiment of a vacuum head device in accordance with the present invention.

FIG. 3 is a top and side perspective view illustrating one embodiment of the vacuum head device 104. The first surface 110 and the second surface 112 form an extraction slot 116. The cross-sectional area of the extraction slot 116 is selected to be large enough to permit solid contaminants that can be expected to be in the liquid to pass through the extraction slot 116 without clogging the extraction slot 116. Since such contaminants are generally larger than the diameter of carpet fibers, the selected cross-sectional area of the extraction slot 116 is larger than the carpet fibers and therefore carpet fibers will not clog the extraction slot 116.

The vacuum head device 104 is designed to minimize the surface area of contact between the carpeted surface 102 and the vacuum head device 104. Since pressure is equal to force divided by the component of surface area that applies such force and that is perpendicular to the body to which force is applied, the pressure exerted by the device upon the fabric is increased by decreasing the surface area of the device that contacts the fabric. Advantageously, the reduced surface area also minimizes wear and tear on carpeted surfaces.

When force is applied to the device, the surface 112 extends farther into the fabric than any other portion of the device. As described above, this allows the second surface 112 to function in a manner similar to a snow plow or squeegee, collecting liquid in the fabric for removal through the extraction slot 116.

Figure 4:
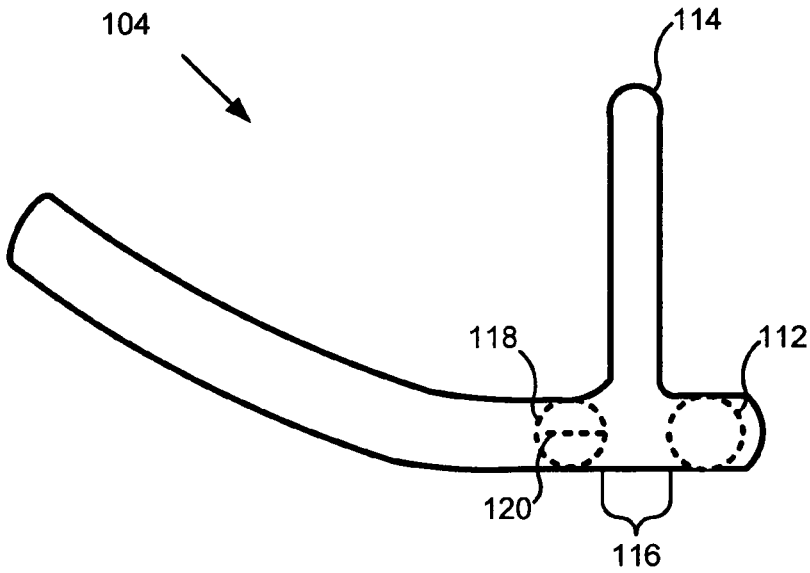
FIG. 4 is a schematic block diagram illustrating one embodiment of a vacuum head device in accordance with the present invention.

FIG. 4 is a schematic block diagram illustrating one embodiment of the vacuum head device 104 of the present invention. In the depicted embodiment, the first surface 118 may comprise a plurality of channels 120. The configuration of the channels 120 will be discussed in greater detail below with reference to FIGS. 5–7. The first surface 118 may be selected with a cross-sectional area substantially equivalent to the second surface 112. Without the plurality of channels 120, such a cross-sectional area would inhibit the flow of liquid towards the extraction slot 116.

Figure 5:
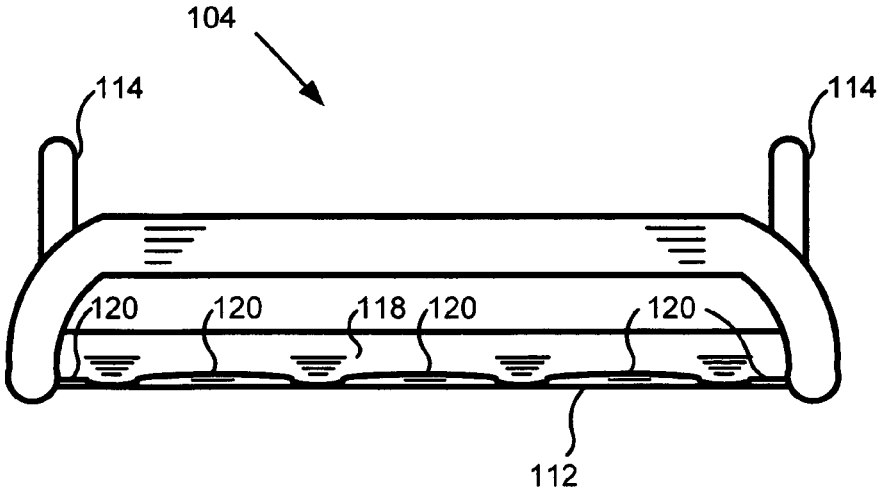
FIG. 5 is a schematic block diagram illustrating one embodiment of a vacuum head device in accordance with the present invention.

Referring now to FIG. 5, shown therein is a front perspective view diagram illustrating one embodiment of the vacuum head device 104. In one embodiment, the first surface 118 comprises a plurality of channels 120. As illustrated, five channels 120 direct fluid towards the extraction slot. However, the first surface 118 may be configured with any number of channels 120 deemed to effectively extract liquid from the carpeted surface 102. The channels preferably extend from the forward edge, or leading surface, of the first surface, or leading portion 118 to the trailing surface of the first surface, or leading portion 118, thereby extending to the extraction slot 116. The channels 120 are preferably formed at the lower end of the first surface 118, such that the channels 120 can be located closer to the fluid at the bottom of the carpeted surface 102. Advantageously, the channels 120 allow fluid to flow into the extraction slot 116 formed by the first surface 118 and the second surface 112.

Figure 6:
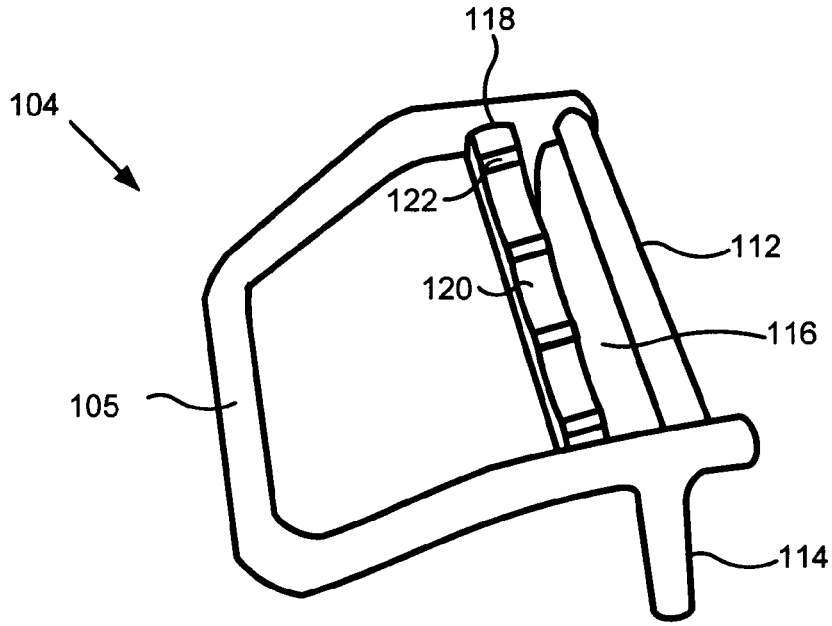
FIG. 6 is a bottom and side perspective view diagram illustrating one embodiment of a vacuum head device in accordance with the present invention.

FIG. 6 is a bottom and side perspective view diagram illustrating one embodiment of the vacuum head device 104. As depicted, the plurality of channels 120 is configured to funnel fluid towards the extraction slot 116. The plurality of channels 120 advantageously allows liquid that may build up in front of the first surface 118 to pass to the extraction slot 116. Additionally, the plurality of channels 120 is formed with a generally rounded profile to minimize damage to the carpeted surface 102.

Alternatively, the plurality of channels may be formed with substantially rectangular contact points 122. The contact points 122 represent the lowest part of the first surface 118, and are the points that apply the most pressure to the carpeted surface 102. The contact points 122 are preferably configured with a small contact surface area. The small contact surface area decreases friction between the vacuum head device 104 and the carpeted surface 102 as the vacuum head device 104 travels over the carpeted surface 102.

Figure 7:
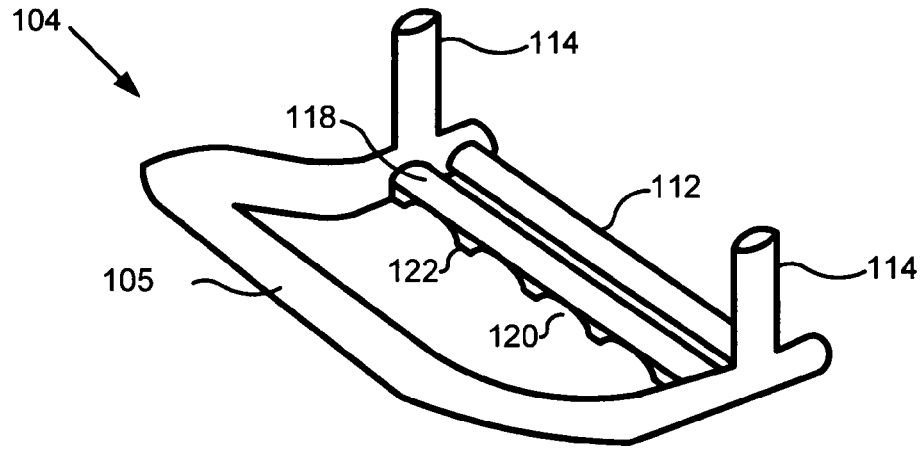
FIG. 7 is a top and side perspective view diagram illustrating one embodiment of a vacuum head device in accordance with the present invention.

Referring now to FIG. 7, shown therein is a top and side perspective view illustrating one embodiment of the vacuum head device 104. As described above, the plurality of channels 120 may be configured with semi-rectangular contact points 122. In a further embodiment, the plurality of channels 120 may be configured with semi-circular contact points 122. A more rounded, gentle profile will decrease drag and damage done to the carpeted surface 102 by the vacuum head device 104.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A vacuum head device for removal of liquid from a fabric, comprising:

a leading portion coupled to the device and configured to penetrate the fabric;

a trailing portion coupled to the device and configured to penetrate the fabric;

an extraction slot formed between the leading portion and trailing portion wherein the leading portion includes a plurality of channels extending from a leading surface of the leading portion to a trailing surface of the leading portion, and the plurality of channels are configured to be in direct physical communication with the fabric when the device is in operation.

2. The vacuum head device of claim 1, wherein the cross section of the leading portion is V-shaped.

3. The vacuum head device of claim 1, wherein the cross section of the trailing portion is V-shaped.

4. The vacuum head device of claim 1, wherein the cross section of the leading portion is substantially circular.

5. The vacuum head device of claim 1, wherein the cross section of the trailing portion is substantially circular.

6. The vacuum head device of claim 1, further comprising a plurality of contact points disposed between the channels configured to apply pressure to the fabric.

7. The vacuum head device of claim 1, wherein the fabric is carpet.

8. The vacuum head device of claim 1, wherein the leading portion is smaller than the trailing portion.

9. The vacuum head device of claim 1, wherein the trailing portion is configured to penetrate the fabric deeper than any other portion of the device.

10. The vacuum head device of claim 1, wherein the plurality of channels comprise generally rounded profiles.

11. The vacuum head device of claim 6, wherein the contact points are generally semi-circular.

12. The vacuum head device of claim 1, wherein the leading portion comprises a rod-shaped member.

13. The vacuum head device of claim 1, wherein the trailing portion is a rod.

14. The vacuum head device of claim 1, wherein the extraction slot extends the entire width of the device.

15. The vacuum head device of claim 1, further comprising a sloping member configured to facilitate travel of the device across the fabric.

16. The vacuum head device of claim 1, wherein the leading portion is smaller than the trailing portion and the trailing portion is configured to penetrate the fabric deeper than any other portion of the device, wherein the device further comprises:

a plurality of contact points disposed between the channels configured to apply pressure to the fabric, wherein the contact points are generally semi-circular and the channels are generally rounded; and a sloping member configured to facilitate travel of the device across the fabric.

17. The vacuum head device of claim 16, wherein the leading portion and the trailing portion each form a V-shaped cross section.

18. The vacuum head device of claim 16, wherein the leading portion and the trailing portion each form a generally circular cross section.

19. The vacuum head device of claim 1, wherein the plurality of channels is formed with a generally rounded profile.

20. The vacuum head device of claim 1, wherein at least one of the plurality of channels is generally funnel shaped.

21. A vacuum head device for removal of liquid from a fabric, comprising:

the first member coupled to the vacuum head device and configured to be proximate the fabric when in use;

a second member coupled to the vacuum head device proximate the first member and configured to penetrate the fabric;

an extraction slot defined by the first and second members, and configured to enable extraction of liquid from the fabric;

a first and a second contact point, each extending from the first member and each configured to be in direct physical communication with the fabric when the device is in operation, neither contact point on a line orthogonal to the first member; and a channel between the first contact point and the second contact point, the channel configured to be in direct physical communication with the fabric when the device is in operation.

22. The vacuum head device of claim 21, further comprising a sloping member coupled to the device and configured to facilitate travel of the device across the fabric.

23. The vacuum head device of claim 21, wherein a cross-section of the second member is V-shaped.

24. The vacuum head device of claim 21, wherein the channel is generally funnel-shaped.

25. The vacuum head device of claim 21, wherein a cross-section of the second member is generally circular.

26. The vacuum head device of claim 21, wherein the first and second contact points are generally semi-circular.

27. The vacuum head device of claim 23, wherein a cross section of the second member is generally V-shaped and wherein the first and second contact points are generally semi-circular.

28. A vacuum head device for removal of liquids from a fabric, comprising:

a trailing member coupled to the vacuum head device, configured to penetrate the fabric, and having a shape that substantially traverses an intended direction of use of the vacuum head device;

a leading member coupled to the trailing member thereby forming an extraction slot between the trailing member and the leading member, configured to penetrate the fabric, and having a shape that substantially traverses an intended direction of use of the vacuum head device; and a channel extending through the leading member and configured to be in direct physical contact with the fabric when the vacuum head device is in operation, wherein the channel is oriented substantially parallel to a direction of use thereby permitting liquid in the fabric to traverse the leading member.

29. The vacuum head device of claim 28, further comprising a sloping member coupled to the device and configured to facilitate travel of the device across the fabric.

30. The vacuum head device of claim 28, wherein a cross-section of the trailing member is generally V-shaped.

31. The vacuum head device of claim 28, wherein the channel is generally rounded.

32. The vacuum head device of claim 28, wherein a cross-section of the trailing member is generally circular.

33. The vacuum head device of claim 29, wherein a cross-section of the trailing member is generally V-shaped.

34. The vacuum head device of claim 29, wherein a cross-section of the trailing member is generally circular.

35. The vacuum head device of claim 29, wherein the channel is generally rounded.

36. The vacuum head device of claim 28, wherein the leading member is generally linear and the trailing member is generally linear.

* * * * *